US005722533A

United States Patent [19]

Gallone

[11] Patent Number: 5,722,533

[45] Date of Patent: Mar. 3, 1998

[54] DEVICE EXERTING A PROTECTIVE ACTION AGAINST FLUID SEEPAGES IN ELECTRICAL SWITCHES AND THE LIKE

[75] Inventor: Flavio Gallone, Cornaredo, Italy

[73] Assignee: Signal Lux S.p.A., Italy

[21] Appl. No.: 626,542

[22] Filed: Apr. 2, 1996

[30] Foreign Application Priority Data

Nov. 30, 1995 [IT] Italy ..... MI95A1505

[51] Int. Cl.[6] ..... H01H 13/06

[52] U.S. Cl. ..... 200/302.2; 200/296; 200/302.1

[58] Field of Search ..... 200/302.2, 302.3, 200/302.1, 296, 341

[56] References Cited

U.S. PATENT DOCUMENTS

| | | | |
|---|---|---|---|
| 3,316,379 | 4/1967 | Clarke et al. | 200/302.2 |
| 4,825,023 | 4/1989 | Morse | 200/302.2 |
| 5,053,591 | 10/1991 | Theurer | 200/302.3 |
| 5,055,643 | 10/1991 | Pardini et al. | 200/341 |
| 5,349,147 | 9/1994 | Gallone | 200/302.2 |

*Primary Examiner*—David J. Walczak

*Attorney, Agent, or Firm*—Laff, Whitesel, Conte & Saret, LTD.

[57] ABSTRACT

A device exerting a protective action against fluid seepages in electrical switches and the like comprises an annular seal (9*a*, 9*b*, 9*c*, 9*d*) perimetrically integral with an external box-shaped body (5) of a switch and operating on a border (4*a*) of a shaped opening (3) formed on the front in a support wall (4) into which the switch is to be engaged. The device further comprises sealing means between the operating push button (8) and a guide collar (15) for said push button provided in a switch.

12 Claims, 1 Drawing Sheet

FIG. 2
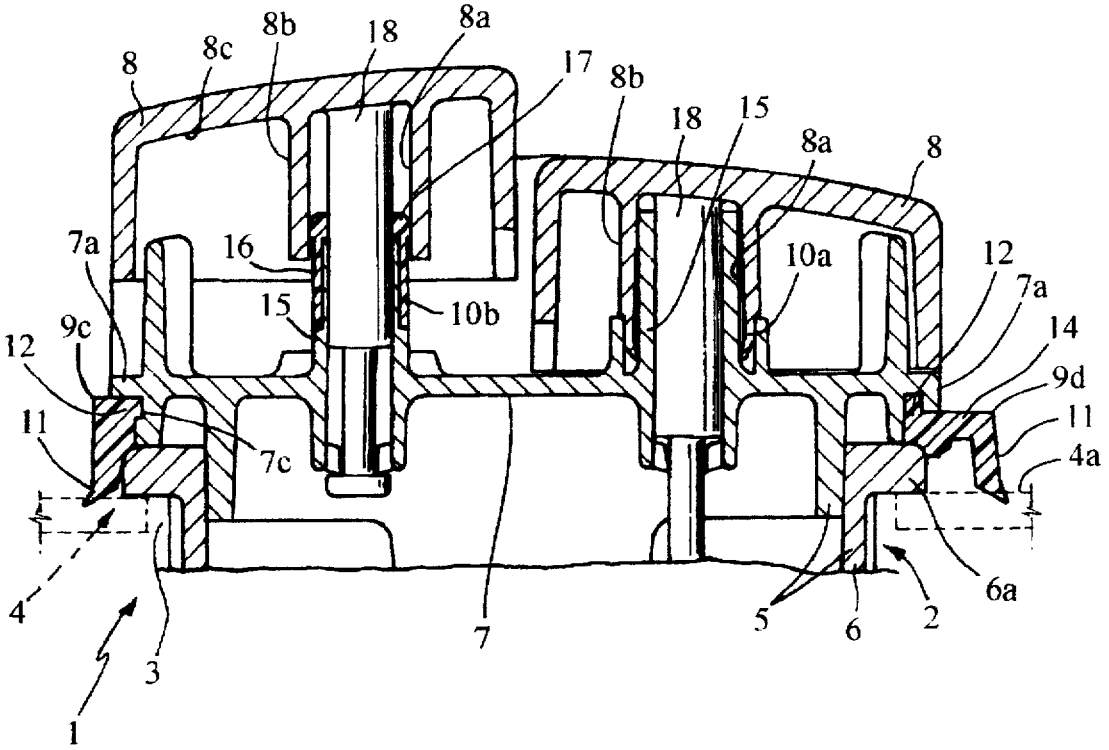
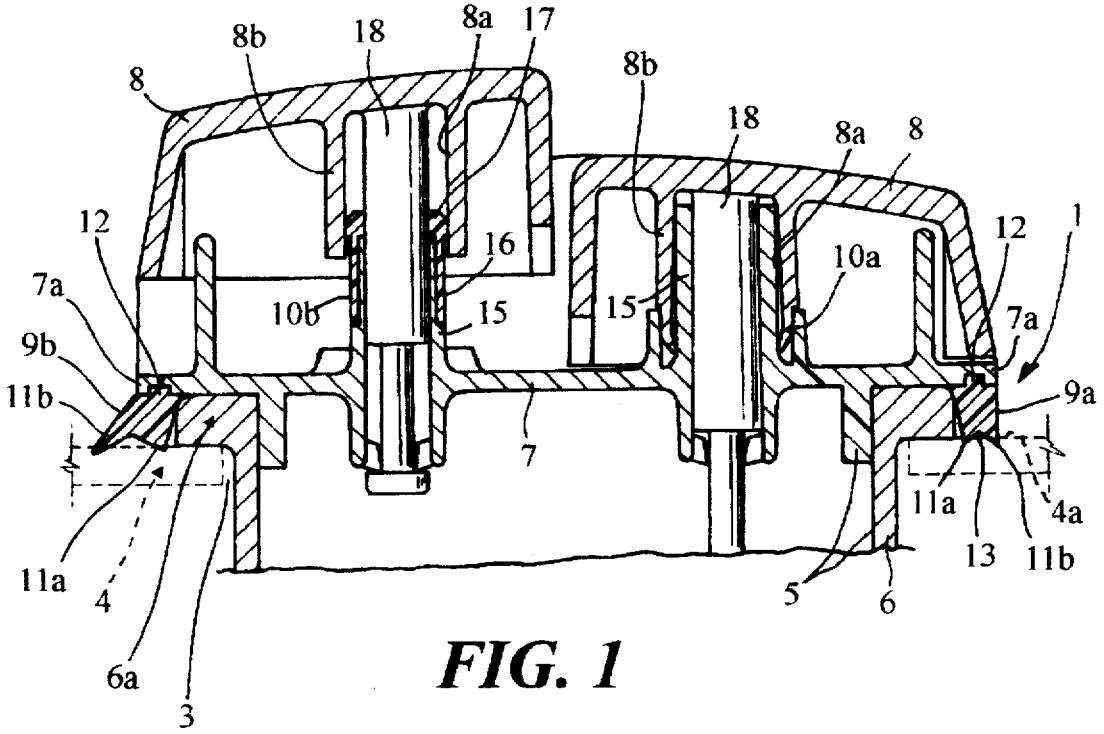
FIG. 1

DEVICE EXERTING A PROTECTIVE ACTION AGAINST FLUID SEEPAGES IN ELECTRICAL SWITCHES AND THE LIKE

BACKGROUND OF THE INVENTION

1. Field of the Invention

The present invention relates to a device exerting a protective action against fluid seepages in electrical switches and the like, one said switch comprising: an external box-shaped body of electrically insulating material housing an electromechanical switching unit and adapted to be engaged in a shaped opening defined in a support wall, at least one operating push button projecting externally of a front side of said box-shaped body and operatively connected with said electromechanical unit, and sealing means adapted to block the seepage of fluids into said box-shaped body and through said shaped opening.

2. Prior Art

It is known that the electrical switches of the above stated type are used in different applications, in appliances for home and/or industrial use for example, which are intended for operation also in environments that may have a high degree of humidity or imply risks of water or other liquid splashes.

In order to protect these switches against seepages that could give rise to problems of some importance from the point of view of a correct operation and safety, in some known technical solutions it is provided that sealing means be associated with said switches, which means may for example consist of a protection cap or covering element of a flexible material, such as silicone or another appropriate material, having a perimetric flange matching with the front portion of the external box-shaped body of the switch by means of a fastening frame separated from or closely connected with the protective element.

Said fastening frame may also have a perimetric lip adapted to act on the surface of a wall in which a shaped opening is formed for embedding the switch therein, so as to achieve a tight seal also between the external box-shaped body of the switch and the wall.

The above described known art however, suffers from some drawbacks that greatly reduce the practical use and reliability of the above solutions.

In fact, the protective element of silicone material and the related fastening frame have high production costs above all if compared with the reduced overall costs of the switches of the type in reference.

In addition, the protective element is easily subjected to cuts or cracks, due to accidental causes or as a result of the frequent use of the switch, that will reduce or completely impair the protective features of same.

In order to overcome the above mentioned drawbacks a protection device against water splashes for electrical switches has been provided which does not use caps or protective elements of silicone or similar materials, but takes advantage of construction solutions in which seals of the O-ring type are required which have low production and installation costs and a fairly good operating reliability also after a prolonged period of use of the switch.

Practically, in this known art the closing means is intended for blocking fluid seepages both into the switch box-shaped body and between said box-shaped body and the edge of the shaped opening formed in the support wall in which the switch is to be embedded.

In particular, the sealing action between the external box-shaped body of the switch and the support wall is achieved by providing an appropriate flush recess disposed perimetrically around the edges of said shaped opening in the wall, in which a locating seating is defined against which a ring seal fitted about a perimetric relief of the box-shaped body abuts.

While this technical solution is efficient from an operating point of view, it involves the use of an expressly shaped support wall provided with the above mentioned recess and related locating seating, the shape of which shall match that of the corresponding relief of the switch provided with a seal.

In addition the seal is a separate element of the switch box-shaped body which, on installation, needs to be positioned in a correct manner. This requirement partly limits the switch simplicity and convenience when said switch is to be fixed in position.

According to the above mentioned known art, in order to prevent seepages to the inside of the box-shaped body, the operating push button projecting externally of the front side of the box-shaped body is arranged to translate, at one internal slide surface thereof, on a guide collar also projecting to the outside and on which said push button is slidably fitted. Provided between the guide collar and said slide surface is also an annular seal of the O-ring type resisting the passage of humidity and liquids towards a transmission rod that, in turn, slidably crosses the guide collar for disconnecting the operating push button from the internal electromechanical unit.

This technical solution too has a limit in that the seal constitutes an additional element separated from the guide collar and, after a prolonged use, it can become worn and come out of its seating.

SUMMARY OF THE INVENTION

Under this situation, the technical task underlying the present invention is to conceive a device exerting a protective action against fluid seepages in electrical switches and the like capable of substantially obviating the above mentioned drawbacks.

Within the scope of said technical task it is an important object of the invention to provide a protective device capable of reducing the production and installation costs of the switches themselves and enabling an increased operating reliability as compared with known technical solutions.

The technical task mentioned and the object specified are substantially achieved by a device exerting a protective action against fluid seepages in electrical switches and the like, wherein said sealing means comprises at least one annular seal perimetrically and externally integral with said box-shaped body and disposed on the box-shaped body itself at a position adapted for operation on a border defined around said shaped opening and positioned at the front on said support wall.

BRIEF DESCRIPTION OF THE DRAWINGS

The description of some preferred embodiments of a device exerting a protective action according to the invention is now taken by way of non-limiting examples with reference to the accompanying drawings, in which:

FIG. 1 is a cross sectional view of the device applied to a switch provided with two push buttons, which is divided into a right half-section and a left half-section corresponding to a first and a second embodiment respectively of two components of the device; and FIG. 2 is a cross sectional view of the device and the switch shown in FIG. 1 divided into left and right halfsections, corresponding to a third and a fourth embodiment respectively of a component of the device.

DESCRIPTION OF THE PREFERRED EMBODIMENTS

With reference to the drawings, the device in accordance with the invention has been generally identified by reference numeral 1.

The device 1 is associated with a switch 2 for preventing seepages thereinto and through a shaped opening 3 of a support wall 4 into which said switch 2 is to be engaged.

The switch 2 conventionally comprises an external box-shaped body 5 of electrically insulating material, consisting of a casing 6 for example provided with a perimetric extension 6*a* intended for abutment against the support wall 4, and of a closing face 7 hermetically associated with the front side of the casing 6.

Externally projecting from said casing is one or more operating push buttons 8 operatively connected to an electromechanical switching unit (not shown as known and conventional), received in the box-shaped body 5.

In the accompanying drawings a switch is shown which is provided for example with two operating push buttons 8 depicted in two distinct operating positions.

The device 1 is defined by sealing means comprising a first component, respectively identified by 9*a*, 9*b*, 9*c*, 9*d* in the different embodiments, which is directed to inhibit fluid seepages into the shaped opening 3 between the box-shaped body 5 and the support wall 4, and a second component, respectively denoted by 10*a* and 10*b* in two different embodiments, intended for preventing liquids from entering the box-shaped body 5 through the operating push buttons 8.

In an original manner said first component is defined by an annular seal perimetrically and externally integral with the box-shaped body 5 at a position adapted to abut, by at least one lip portion 11, against a border 4*a* positioned at the front on the support wall 4 and defined around the shaped opening 3. The annular seal 9*a*, 9*b*, 9*c*, 9*d* comprises an attachment portion 12 fixed in an irremovable manner to a perimetric relief 7*a* of the box-shaped body 5, formed in the closing face 7 for example.

In a first embodiment thereof, shown in the right half-section in FIG. 1 and denoted at 9*a*, the annular seal comprises two lip-shaped portions 11*a* and 11*b* mutually spaced apart and coaxial, so as to define an empty annular space 13 between them, which will enable them to act as a suction cup on the border 4*a*. More particularly the lip portions comprise an inner lip portion 11*a* and an outer lip portion 11*b* which is in alignment with an external edge of the perimetric relief 7*a*.

In a second embodiment thereof shown in the left half-section in FIG. 1, the annular seal denoted by 9*b* is similar to that of the first embodiment 9*a*, that is it is provided with two lip portions 11*a* and 11*b* adapted to create a suction cup, but the external lip portion 11*b* projects from the external edge of the perimetric relief 7*a*.

In a third embodiment, depicted in the left half-portion in FIG. 2 and denoted by 9*c*, the seal has a single lip portion 11 and an attachment portion 12 the shape of which matches that of an angular seating 7*c* formed in the closing face 7.

In a fourth embodiment, depicted in the right half-section in FIG. 2 and denoted by 9*d*, the annular seal comprises a central portion 14 between the lip portion 11 and attachment portion 12, which central portion extends away from the perimetric relief 7*a* so that the lip portion 11 can be positioned spaced apart from the perimetric abutment extension 6*a* of the casing 6.

The second component embodying the sealing means of the device 1 couteracts fluid seepages to the inside of the box-shaped body 5 and more particularly it is active between the guide collar 15 projecting externally of the front side of the box-shaped body 5, and a respective operating push button 8 slidably in engagement on the collar itself at a slide surface 8*a* which is for example defined by the inner face of a sleeve portion 8*b* extending away from a bottom surface 8*c* of the push button 8 itself.

In one embodiment thereof shown in the right half-section of FIG. 1 and denoted at 10*a*, said second component of the device 1 is defined by a substantially flexibile annular extension in the form of a lip, provided on the slide surface 8*a* of the operating push button 8. The annular extension 10*a* is adapted to spring-abut against the guide collar 15 so as to create a hermetic closure between said collar and the slide surface 8*a* both during the push button translation and the rest postion of said push button.

In a second embodiment shown in the left half-section of FIG. 1 and denoted at 10*b*, the second component of the device 1 is defined by a bushing of plastic material surrounding the guide collar 15 and integral therewith. The bushing 10*b* comprises a tubular base portion 16 in engagement in an irremovable manner with the collar 15, and a sealing portion 17 slightly projecting from the base portion 16 and adapted to spring-abut against the slide surface 8*a* of the operating push button 8, and also against a drive rod 18 connected with the operating push button 8.

Advantageously both the annular seals 9*a*, 9*b*, 9*c*, 9*d* and the bushing 10*b* are manufactured, in one and the same moulding step, together with the switch parts with which they are to be associated in an irremovable manner, that is the box-shaped body 5 and guide collar 15 respectively.

The invention achieves important advantages.

In fact the device, in addition to not using protective elements in the form of caps made of silicone or similar materials, does not require specific and appropriate conformations for the border of the shaped opening formed in the support wall into which the switch associated with the device is to be engaged. The annular seal exerting a protective action against seepages between the switch box-shaped body and the edges of the support wall opening, can in fact abut against a flat border which is directly part of the support wall. Furthermore, all components of the sealing means have been already fastened in an irremovable manner to the respective switch parts during the switch manufacturing step and therefore do not require appropriate assembling steps on installation of the switch.

For the above reasons, both the production and installation costs of the switches with which the devices according to the invention are associated, are further reduced as compared with those of the known art. Finally, the operating reliability of the device of the invention is substantially increased first of all because the static sealing action between the switch and support wall is very efficient in particular in the embodiments provided with a double lip. In addition, it is to note that sliding between the guide face and the push button takes place either along an area directly formed in the body of the push button itself or along a wide area at the guide collar of the push button. As a result, this sealing action takes place exactly at the right place and is always efficient and active after a prolonged use of the switch.

Many modifications and variations may be made to the invention as conceived, all of them falling within the scope of the inventive idea. In practically carrying out the invention, the materials, shapes and sizes may be of any nature and magnitude depending on requirements.

What is claimed is:

1. A device exerting a protective action against fluid seepages in electrical switches, one said switch comprising:

an external box-shaped body (5) of electrically insulating material housing an electromechanical switching unit and adapted to be engaged in a shaped opening (3) defined in a support wall (4), at least one operating push button (8) projecting externally of a front side of said box-shaped body (5) and operatively connected with said electromechanical unit; and sealing means adapted to block the seepage of fluids into said box-shaped body (5) and through said shaped opening (3), wherein said sealing means comprises at least one annular seal (9*a*, 9*b*, 9*c*, 9*d*) perimetrically and externally integral with said box-shaped body (5) and disposed on the box-shaped body itself at a position adapted for operation on a border (4*a*) defined around said shaped opening (3) and positioned at the front on said support wall (4) said annular seal (9*a*, 9*b*, 9*c*, 9*d*) comprising at least one lip portion spaced from an outer edge portion of said body and (11, 11*a*, 11*b*) exhibiting a beveled edge adapted to abut against said border (4*a*) of said support wall (4).

2. The device as claimed in claim 1, wherein said annular seal (9*a*, 9*b*, 9*c*, 9*d*) comprises an attachment portion (12) fastened in an irremovable manner to a perimetric relief (7*a*) of said external box-shaped body (5).

3. The device as claimed in claim 2, wherein said annual seal (9*a*) has two of said lip portions (11*a*, 11*b*) mutually spaced apart and coaxial, so as to define an empty space (13) between them which will enable them to act as a suction cup on said support wall (4), said lip portions (11*a*, 11*b*) comprising an outer lip portion (11*b*) which is in alignment with an external edge of said perimetric relief (7*a*).

4. The device as claimed in clam 2, wherein said annual seal (9*b*) has two of said lip portions (11*a*, 11*b*) mutually spaced apart and coaxial, so as to define an empty space (13) between them which will enable them to act as a suction cup on said support wall (4), said lip portions (11*a*, 11*b*) comprising an outer lip portion (11*b*) substantially projecting from an external edge of said perimetric relief (7*a*).

5. The device as claimed in claim 2, wherein said annular seal (9*d*) comprises a central portion (14) included between said attachment portion (12) and lip portion (11) and extending away from said attachment portion (12) so that said lip portion (11) is spaced apart from a perimetric extension (6*a*) of said external box-shaped body (5) for abutment of the latter against said support wall (4).

6. The device as claimed in claim 2, wherein said attachment portion (12) of said annular seal (9*a*, 9*b*, 9*c*, 9*d*) has a shape that substantially matches that of an angular seating (7*a*) formed in said box-shaped body (5).

7. The device as claimed in claim 1, wherein said annular seal (9*a*, 9*b*, 9*c*, 9*d*) is made during the same moulding step as said external box-shaped body (5).

8. A device exerting a protective action against fluid seepages in electrical switches, one said switch comprising:

an external box-shaped body (5) made of electrically insulating material and housing an electromechanical switching unit;

at least one operating push button (8) projecting externally of a front side of said box-shaped body (5) and operatively connected with said electromechanical unit;

a guide collar (15) for said push button projecting externally of the box-shaped body (5), said push button (8) being slidably in engagement on the guide collar by a slide surface (8*a*) movable on said guide collar (15) and defined by a inner face of a sleeve portion of the push button sealing means operatively engaged between said slide surface (8*a*) of the operating push button (8) and said collar (15), wherein said sealing means is defined by at least one substantially flexible annular extension of said slide surface (8*a*) of the operating push button (8) wherein said annular extension and said push button are molded together as a one piece unit and wherein said annular extension is adapted to spring-abut against said guide collar (15) to thereby seal said push button to said guide collar.

9. The device as claimed in claim 8, wherein said flexible annular extension is in the form of a lip exhibiting a beveled edge.

10. The device as claimed in claim 1 wherein said annular seal (9*c*) has a single lip portion (11) and an attachment portion (12), said attachment portion (12) having a shape which matches an angular seating (7*c*) formed in said box-shaped body (5).

11. The device of claim 10 comprising a guide collar (15) for said push button (8) projecting externally of the box-shaped body (5), said push button (8) being internally provided with a slide surface (8*a*) movable on said guide collar (15), sealing means operatively engaged between said slide surface (8*a*) of the operating push button (8) and said collar (15), wherein said sealing means is defined by at least one substantially flexible annular extention of said slide surface (8*a*) of the operating push button (8) which is adapted to spring-abut against said guide collar (15).

12. The device as claimed in claim 1, wherein said annular seal (9*a*, 9*b*) comprises two of said lip portions (11*a*, 11*b*) mutually spaced apart and coaxial, so as to define an empty annual space (13) between them which will enable them to act as a suction cup on said support wall (4).

* * * * *